US011239011B2

(12) United States Patent
Kuniyoshi

(10) Patent No.: US 11,239,011 B2
(45) Date of Patent: Feb. 1, 2022

(54) SINTERED R-T-B BASED MAGNET

(71) Applicant: HITACHI METALS, LTD., Tokyo (JP)

(72) Inventor: Futoshi Kuniyoshi, Minato-ku (JP)

(73) Assignee: HITACHI METALS, LTD., Tokyo (JP)

( * ) Notice: Subject to any disclaimer, the term of this patent is extended or adjusted under 35 U.S.C. 154(b) by 82 days.

(21) Appl. No.: 16/826,380

(22) Filed: Mar. 23, 2020

(65) Prior Publication Data

US 2020/0312492 A1 Oct. 1, 2020

(30) Foreign Application Priority Data

Mar. 25, 2019 (JP) ..... JP2019-056142
Sep. 27, 2019 (JP) ..... JP2019-176506

(51) Int. Cl.
*H01F 1/057* (2006.01)
*H01F 41/02* (2006.01)
*C22C 38/00* (2006.01)

(52) U.S. Cl.
CPC ..... *H01F 1/057* (2013.01); *C22C 38/005* (2013.01); *H01F 41/0293* (2013.01); *C22C 2202/02* (2013.01)

(58) Field of Classification Search
None
See application file for complete search history.

(56) References Cited

U.S. PATENT DOCUMENTS

2008/0286595 A1 11/2008 Yoshimura et al.
2015/0162117 A1* 6/2015 Komuro ..... C22C 1/02 335/302
2015/0235747 A1 8/2015 Miyamoto et al.
2017/0263379 A1* 9/2017 Mino ..... C22C 38/16
2018/0158582 A1* 6/2018 Masusawa ..... C22C 38/14
2019/0185971 A1 6/2019 Kuniyoshi
2019/0371522 A1 12/2019 Kuniyoshi

FOREIGN PATENT DOCUMENTS

EP 3 330 984 A1 6/2018
WO 2007/102391 A1 9/2007
WO 2018/034264 A1 2/2018
WO 2018/143230 A1 8/2018

* cited by examiner

*Primary Examiner* — Xiaowei Su
(74) *Attorney, Agent, or Firm* — Keating & Bennett, LLP

(57) ABSTRACT

A sintered R-T-B based magnet has remanence ($B_r$) of 1.47 T or greater and coercivity ($H_{cJ}$) of 1900 kA/m or greater and contains Tb at a content of 0.35 mass % or lower.

1 Claim, 2 Drawing Sheets

SINTERED R-T-B BASED MAGNET

BACKGROUND

1. Technical Field

The present invention relates to a sintered R-T-B based magnet.

2. Description of the Related Art

Sintered R-T-B based magnets (where R is at least one rare-earth element; T is mainly Fe; and B is boron) are known as permanent magnets with the highest performance, and are used in voice coil motors (VCM) of hard disk drives, various types of motors such as motors for electric vehicles (EV, HV, PHV, etc.) and motors for industrial equipment, home appliance products, and the like.

A sintered R-T-B based magnet includes a main phase which is mainly formed of an $R_2T_{14}B$ compound and a grain boundary phase that is at the grain boundaries of the main phase. The $R_2T_{14}B$ compound, which is the main phase, is a ferromagnetic material having high saturation magnetization and an anisotropy field, and provides a basis for the properties of the sintered R-T-B based magnet.

There exists a problem in that coercivity $H_{cJ}$ (hereinafter, simply referred to as "$H_{cJ}$") of sintered R-T-B based magnets decreases at high temperatures, thus causing an irreversible thermal demagnetization. For this reason, sintered R-T-B based magnets for use in motors for electric vehicles, in particular, are required to have high $H_{cJ}$ even at high temperatures, i.e., to have higher $H_{cJ}$ at room temperature.

CITATION LIST

Patent Literature

[Patent Document 1] International Publication No. 2007/102391

[Patent Document 2] International Publication No. 2018/143230

SUMMARY

It is known that in the case where a light rare-earth element RL (mainly, Nd, Pr) in an $R_2T_{14}B$-based compound phase is replaced with a heavy rare-earth element RH (mainly, Tb, Dy), the $H_{cJ}$ is improved. However, there is a problem that such a replacement, although improving the $H_{cJ}$, decreases the saturation magnetization of the $R_2T_{14}B$-based compound phase and therefore, decreases remanence $B_r$ (hereinafter, simply referred to as "$B_r$"). Tb, particularly, is existing in a small quantity as resources and is produced in limited areas. For this and other reasons, Tb has problems of not being supplied stably and changing in costs. Therefore, it is demanded to provide high $H_{cJ}$ while suppressing the decrease in the $B_r$ with Tb being used as little as possible (with Tb being used in a minimum possible amount).

International Publication No. 2007/102391 describes, while supplying RH onto the surface of a sintered magnet of an R-T-B based alloy, allowing RH to diffuse into the interior of the sintered magnet. According to the method described in International Publication No. 2007/102391, RH is diffused from the surface of the sintered R-T-B based magnet into the interior thereof, thus allowing RH to thicken only in the outer crust of a main phase crystal grain, which is effective for the $H_{cJ}$ improvement. Thus, high $H_{cJ}$ is provided with a suppressed decrease in the $B_r$.

International Publication No. 2018/143230 describes diffusing RL and Ga together with RH into the interior of a magnet via grain boundaries from a surface of a sintered R-T-B based work. The method described in International Publication No. 2018/143230 allows the diffusion of RH into the interior of the magnet to progress significantly, and thus provides extremely high $H_{cJ}$ while decreasing the amount of RH to be used.

However, it has been recently demanded, particularly for, for example, the motors for electric vehicles, to provide higher $B_r$ and higher $H_{cJ}$ while decreasing the amount of use of RH, especially, Tb.

Various embodiments of the present disclosure provide sintered R-T-B based magnets having high $B_r$ and high $H_{cJ}$ with the amount of use of Tb being decreased.

A sintered R-T-B based magnet according to the present disclosure, in an illustrative embodiment, has remanence ($B_r$) of 1.47 T or greater and coercivity ($H_{cJ}$) of 1900 kA/m or greater and containing Tb at a content of 0.35 mass % or lower.

In an embodiment, the sintered R-T-B based magnet contains RL (RL is at least one type of light rare-earth element, and contains Nd and Pr with no exception), and satisfies 26.5 mass %≤[RL]−6×[oxygen]≤28.8 mass %, where [RL] is the content (mass %) of RL and [oxygen] is the content (mass %) of oxygen.

In an embodiment, the sintered R-T-B based magnet includes a portion in which a concentration of Tb gradually decreases from a surface toward an interior of the magnet.

In an embodiment, the sintered R-T-B based magnet includes a portion in which a concentration of Pr gradually decreases from a surface toward an interior of the magnet.

In an embodiment, the sintered R-T-B based magnet includes a portion in which a concentration of Ga gradually decreases from a surface toward an interior of the magnet.

In an embodiment, the content of Tb is 0.30 mass % or lower.

In an embodiment, the sintered R-T-B based magnet satisfies 0.01 mass %≤[oxygen]≤0.15 mass %, where [oxygen] is the content (mass %) of oxygen.

An embodiment of the present disclosure provides a sintered R-T-B based magnet having high $B_r$ and high $H_{cJ}$ with the amount of use of Tb being decreased.

DETAILED DESCRIPTION

First, a fundamental structure of a sintered R-T-B based magnet according to the present disclosure will be described. The sintered R-T-B based magnet has a structure in which powder particles of a raw material alloy are bound together through sintering, and includes a main phase which is mainly formed of $R_2T_{14}B$ compound particles and a grain boundary phase which is at the grain boundaries of the main phase.

Figure 1A:
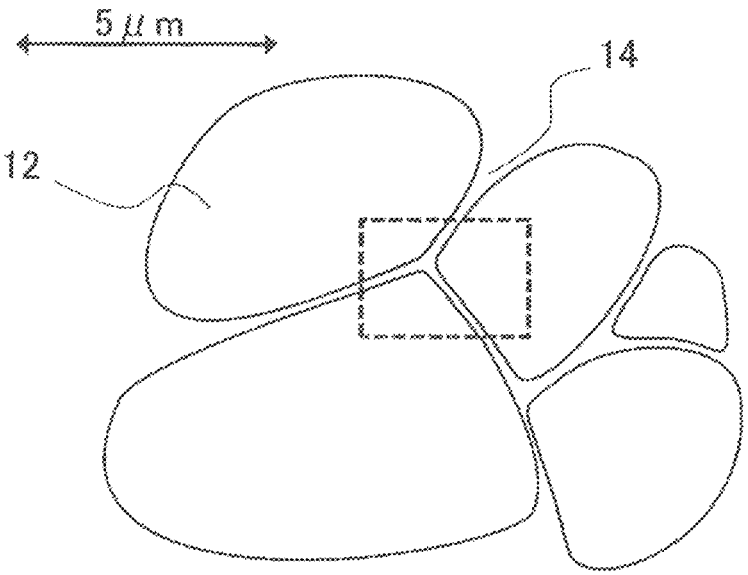
FIG. 1A is a partially enlarged cross-sectional view schematically showing a sintered R-T-B based magnet.
Figure 1B:
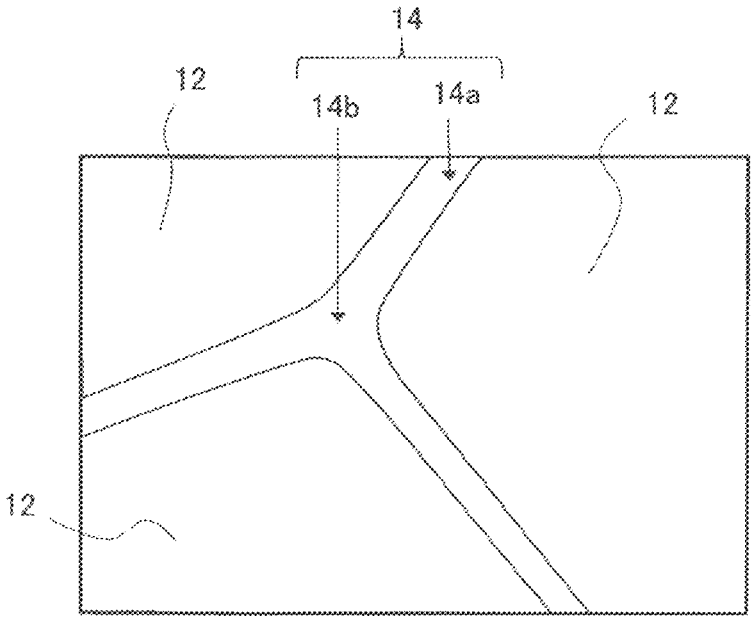
FIG. 1B is a further enlarged cross-sectional view schematically showing the interior of a broken-lined rectangular region in FIG. 1A.

FIG. 1A is a partially enlarged cross-sectional view schematically showing a sintered R-T-B based magnet. FIG. 1B is a further enlarged cross-sectional view schematically showing the interior of a broken-lined rectangular region in FIG. 1A. In FIG. 1A, a left-right arrow indicating a length of 5 μm is shown as an example of reference length to represent size. As shown in FIG. 1A and FIG. 1B, the sintered R-T-B based magnet includes a main phase 12 mainly formed of an $R_2T_{14}B$ compound and a grain boundary phase 14 at the grain boundaries of the main phase 12. As shown in FIG. 1B, the grain boundary phase 14 includes an intergranular grain boundary phase 14*a*, along which two $R_2T_{14}B$ compound grains adjoin each other, and a grain boundary triple junction 14*b*, at which three $R_2T_{14}B$ compound grains adjoin one another. A typical crystal grain size of the main phase is not less than 3 μm and not more than 10 μm, this being an average value of the diameter of an approximating circle in the cross section of the magnet. The $R_2T_{14}B$ compound, which forms the main phase 12, is a ferromagnetic material having high saturation magnetization and an anisotropy field. Therefore, in a sintered R-T-B based magnet, it is possible to improve the $B_r$ by increasing the abundance ratio of the $R_2T_{14}B$ compound, which forms the main phase 12. In order to increase the abundance ratio of the $R_2T_{14}B$ compound, the R amount, the T amount and the B amount in the raw material alloy may be brought closer to the stoichiometric ratio of the $R_2T_{14}B$ compound (i.e., the R amount:the T amount:the B amount=2:14:1).

As described above, in, for example, International Publication No. 2018/143230, RL (particularly, Pr) and Ga are diffused together with RH (particularly, Tb) from the surface of a sintered R-T-B based work (in the present disclosure, a surface of a sintered R1-T-B based magnet work) into the interior of the magnet via the grain boundaries. This significantly progresses the diffusion of Tb into the interior of the magnet and thus provides extremely high $H_{cJ}$. However, as a result of studies, the present inventor has found that the diffusion of Pr and Ga into the interior of the magnet increases the width of the intergranular grain boundary phase, which may possibly decrease the volumetric ratio of the main phase and thus decrease the $B_r$. As a result of further studies, the present inventor has conceived that in order to significantly progress the diffusion of Tb and thus to provide high $H_{cJ}$, Pr and Ga need to be diffused in minimum possible amounts although the diffusion of Pr and Ga is effective to provide high $H_{cJ}$. In addition, Pr and Ga are diffused from the surface of the sintered R1-T-B based magnet work via the grain boundaries. Therefore, the present inventor has assumed that control on the grain boundaries (control on the amount and the size of the grain boundaries) of the sintered R1-T-B based magnet work may control the amount of diffusion of Pr and Ga into the interior of the magnet. As a result of studies made based on such knowledge, the present inventor has found the following: Pr and Ga are diffused together with Tb to the sintered R1-T-B based magnet work under the conditions that the amount of RLL (RLL is at least one type of light rare-earth element and contains Nd no exception) and the amount of oxygen both contained in the sintered R1-T-B based magnet work are adjusted to the range of 26.3 mass %≤[RLL]−6×[oxygen]≤28.6 mass % (where [RLL] is the content (mass %) of RLL, and [oxygen] is the content (mass %) of oxygen); in this case, neither Pr nor Ga is diffused excessively into the interior of the magnet, and the diffusion of Tb significantly progresses.

The sintered R-T-B based magnet obtained in the above-described manner has remanence ($B_r$) of 1.47 T or greater, coercivity ($H_{cJ}$) of 1900 kA/m or greater, and a content of Tb of 0.35 mass % or lower (preferably, 0.30 mass % or lower). As can be seen, the obtained sintered R-T-B based magnet has extremely high $B_r$ and extremely high $H_{cJ}$ with the amount of use of Tb being decreased. At this point, the amount of RL (RL is at least one type of light rare-earth element and contains Nd and Pr no exception) contained in the sintered R-T-B based magnet (after diffusion) is in the range of 26.5 mass %≤[RL]−6×[oxygen]≤28.8 mass %, where [RL] is the content (mass %) of RL, and [oxygen] is the content (mass %) of oxygen.

The "magnetic characteristics" of the $B_r$ and the $H_{cJ}$ of the sintered R-T-B based magnet refer to the magnetic characteristics of the entirety of the magnet, and may be measured by, for example, a B-H tracer. In the case where the magnet is too large and the magnetic characteristics of the entirety of the magnet cannot be measured, a corner (end) of the magnet, for example, may be processed into a cube of approximately 7 mm per side (7 mm×7 mm×7 mm) and this cube may be measured by the B-H tracer. In the case where the magnet is too small, a plurality of magnets may be stacked to form a cube of approximately 7 mm per side, and this cube may be measured by the B-H tracer. The above-mentioned contents of Tb, RL and oxygen indicate the composition of the entirety of the magnet (average composition). The contents of Tb and RL may be measured for the entirety of the magnet by use of, for example, Inductivity Coupled Plasma Optical Emission Spectroscopy (ICP-OES). The content of oxygen may be measured by, for example, a gas fusion infrared absorption method by use of a gas analyzer.

(Sintered R-T-B Based Magnet)

The sintered R-T-B based magnet according to the present disclosure contains Tb at a content of 0.35 mass % or lower (preferably, 0.30 mass % or lower). The sintered R-T-B based magnet according to the present disclosure includes a portion in which a concentration of Tb gradually decreases from the surface toward the interior of the magnet, a portion in which a concentration of Pr gradually decreases from the surface toward the interior of the magnet, and a portion in which a concentration of Ga gradually decreases from the surface toward the interior of the magnet. A state where the sintered R-T-B based magnet includes the portions in which the Tb concentration, the Pr concentration and the Ga concentration gradually decrease from the surface toward the interior of the magnet indicates a state where Tb, Pr and Ga are diffused from the surface into the interior of the magnet. The state where "the sintered R-T-B based magnet includes the portions in which the Tb concentration, the Pr concentration and the Ga concentration gradually decrease from the surface toward the interior of the magnet" may be confirmed by, for example, a line analysis performed by energy dispersive x-ray spectroscopy (EDX) on any cross-section of the sintered R-T-B based magnet, specifically, on a region from the surface to the vicinity of the center of the cross-section of the magnet. The Tb, Pr and Ga concentrations may each be locally decreased or increased in accordance with whether the site of the measurement is the main phase crystal grains ($R_2T_{14}B$ compound grains) or the boundaries or in accordance with the type or presence/absence of the compound containing Tb, Pr and Ga generated in the pre-diffusion sintered R1-T-B based magnet work or at the time of diffusion. However, the overall Tb, Pr and Ga concentrations are gradually decreased from the surface to the interior of the magnet (the concentrations are gradually lowered). Therefore, the "state where the sintered R-T-B based magnet includes the portions in which the Tb concentration, the Pr concentration and the Ga concentration gradually decrease from the surface to the interior of the magnet" in the sense of the present disclosure encompasses a state where the overall Tb, Pr and Ga concentrations are gradually decreased from the surface to the interior of the magnet, more specifically, at least to a depth of 200 μm, even if the Tb, Pr and Ga concentrations are locally decreased or increased.

The sintered R-T-B based magnet according to the present disclosure contains RL (RL is at least one type of light rare-earth element and contains at least one of Nd and Pr with no exception), and satisfies 26.5 mass %≤[RL]−6×[oxygen]≤28.8 mass %, where [RL] is the content (mass %) of RL, and [oxygen] is the content (mass %) of oxygen. Hereinafter, "[RL]−6×[oxygen]" may be referred to as R'. In the case where R' is lower than 26.5 mass %, Tb, Pr and Ga are difficult to be diffused from the surface into the interior of the magnet, which may possibly decrease the $H_{cJ}$. In the case where R' exceeds 28.8 mass %, Tb, Pr and Ga are excessively diffused from the surface into the interior of the magnet, which may possibly decrease the $B_r$. Preferably, R' is not lower than 27.0 mass % and not higher than 28.0 mass % (27.0 mass %≤[RL]−6×[oxygen]≤28.0 mass %). With such a range of R', the sintered R-T-B based magnet has higher $B_r$ and higher $H_{cJ}$. The content (mass %) of RL is 90 mass % or higher of the overall content of R. In the case where the content of RL is lower than 90 mass % of the overall content of R, the $B_r$ may possibly be decreased.

The sintered R-T-B based magnet according to the present disclosure having such features has remanence ($B_r$) of 1.47 T or greater and coercivity ($H_{cJ}$) of 1900 kA/m or greater. As can be seen, the sintered R-T-B based magnet has extremely high $B_r$ and extremely high $H_{cJ}$ with the amount of use of Tb being decreased.

The sintered R-T-B based magnet has, for example, the following composition.

R: not lower than 26.8 mass % and not higher than 31.5 mass % (R is at least one type of rare-earth element, and contains Tb and RL. The content of RL is 90 mass % or higher of the overall content of R).

B: not lower than 0.80 mass % and not higher than 1.20 mass %

M: not lower than 0.05 mass % and not higher than 1.0 mass % (M is at least one selected from the group consisting of Ga, Cu, Zn and Si.)

M1: not lower than 0 mass % and not higher than 2.0 mass % (M1 is at least one selected from the group consisting of Al, Ti, V, Cr, Mn, Ni, Zr, Nb, Mo, Ag, In, Sn, Hf, Ta, W, Pb and Bi.)

The sintered R-T-B based magnet contains remaining part T (T is Fe, or Fe and Co) and unavoidable impurities in addition to the above-listed components.

The RL is a light rare-earth element, and contains Nd and Pr with no exception. It is preferred that the content of Nd and Pr in RL is 90 mass % or higher of the overall content of RL. Examples of the light rare-earth element include La, Ce, Nd, Pr, Pm, Sm, Eu and the like. Examples of the unavoidable impurities include O (oxygen), N (nitrogen), C (carbon) and the like. In order to provide higher $B_r$ and higher $H_{cJ}$, it is preferred that the sintered R-T-B based magnet satisfies 0.01 mass %≤[oxygen]≤0.15 mass %, where [oxygen] is the content (mass %) of oxygen.

Preferably, the sintered R-T-B based magnet satisfies the following expression (1), where [T] is the content (mass %) of T, and [B] is the content (mass %) of B.

$$[T]/55.85>14\times[B]/10.8 \quad (1)$$

The sintered R-T-B based magnet satisfying expression (1) indicates that the content of B is lower than the content defined by the stoichiometric ratio of the $R_2T_{14}B$ compound, namely, indicates that the amount of B is smaller than the amount of T used to form the main phase ($R_2T_{14}B$ compound). In the case of satisfying expression (1), the sintered R-T-B based magnet has higher $H_{cJ}$.

Figure 2:
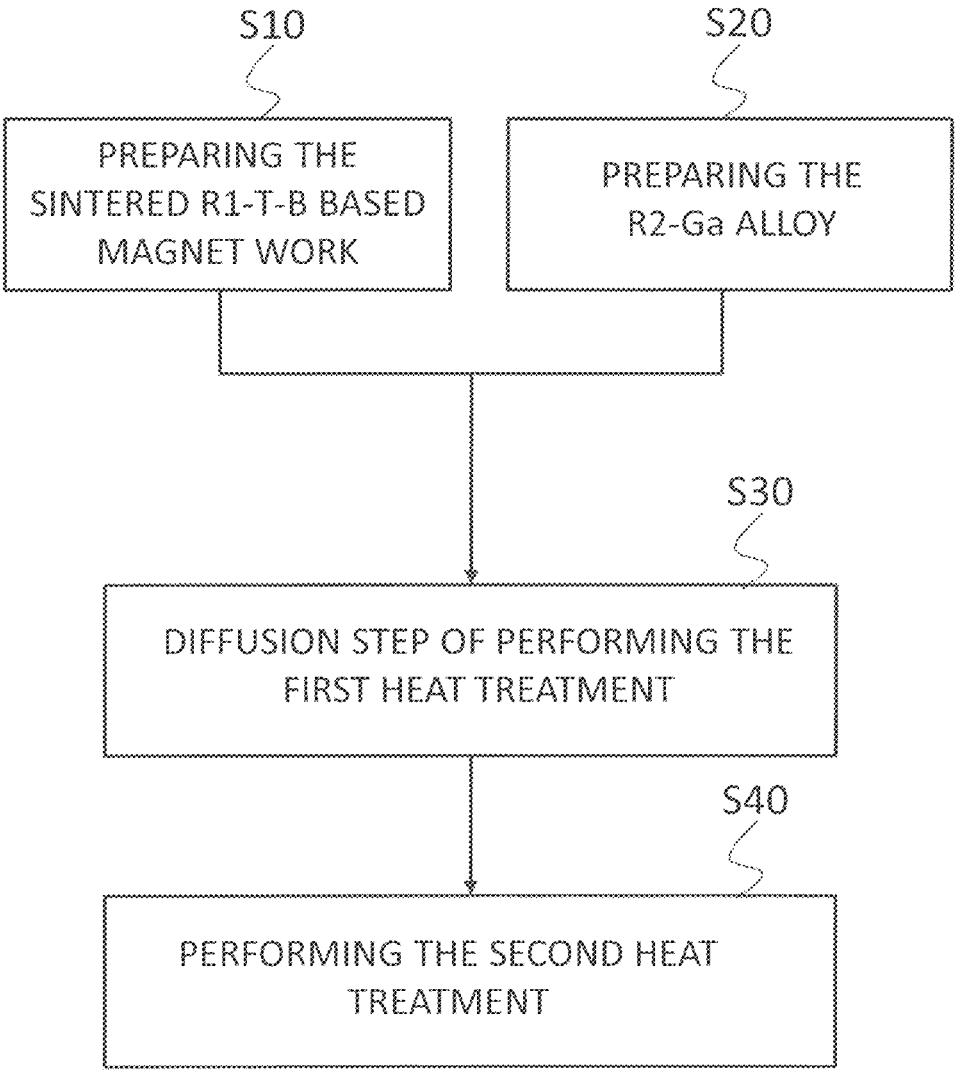
FIG. 2 is a flowchart showing example steps in a method for producing a sintered R-T-B based magnet according to the present disclosure.

The sintered R-T-B based magnet according to the present disclosure is produced by a method shown in, for example, FIG. 2. The method shown in FIG. 2 includes step S10 of preparing a sintered R1-T-B based magnet work, step S20 of preparing an R2-Ga alloy, step S30 (diffusion step) of, while keeping at least a portion of the R2-Ga alloy in contact with at least a portion of a surface of the sintered R1-T-B based magnet work, performing a first heat treatment at a temperature that is not lower than 700° C. and not higher than 950° C. in a vacuum or an inert gas atmosphere to diffuse R2 and Ga into the interior of the magnet work, and step S40 of performing a second heat treatment on the sintered R-T-B based magnet, obtained as a result of the first heat treatment, at a temperature that is not lower than 450° C. and not higher than 750° C. but is lower than the temperature used for the first heat treatment, in a vacuum or an inert gas atmosphere. Hereinafter, the steps will be described.

In the present disclosure, the sintered R-T-B based magnet before and during the diffusion will be referred to as the "sintered R1-T-B based magnet work", and the sintered R-T-B based magnet after the diffusion will be referred to simply as the "sintered R-T-B based magnet".

(Step of Preparing a Sintered R1-T-B Based Magnet Work)

First, a composition of the sintered R1-T-B based magnet work will be described.

One feature of the sintered R1-T-B based magnet work according to the present disclosure is that the amount of RLL (RLL is at least one type of light rare-earth element, and contains Nd with no exception) and the amount of oxygen both contained therein are adjusted to be in a certain range. Specifically, the amounts of RLL and oxygen are in the range of 26.3 mass %≤[RLL]−6×[oxygen]≤28.6 mass %, where [RLL] is the content (mass %) of RLL, and [oxygen] is the content (mass %) of oxygen. The diffusion step described below is performed on such a sintered R1-T-B based magnet work, and as a result, neither Pr nor Ga is excessively diffused into the interior of the sintered R1-T-B based magnet work, and the diffusion of Tb significantly progresses.

The sintered R1-T-B based magnet work has, for example, the following composition.

R1: not lower than 26.6 mass % and not higher than 31.3 mass % (R1 is at least one type of rare-earth element, and contains RLL. The content of RLL is 90 mass % or higher of the overall content of R1).

B: not lower than 0.80 mass % and not higher than 1.20 mass %

M: not lower than 0 mass % and not higher than 1.0 mass % (M is at least one selected from the group consisting of Ga, Cu, Zn and Si.)

Ma: not lower than 0 mass % and not higher than 2.0 mass % (M1 is at least one selected from the group consisting of Al, Ti, V, Cr, Mn, Ni, Zr, Nb, Mo, Ag, In, Sn, Hf, Ta, W, Pb and Bi.)

The sintered R1-T-B based magnet work contains remaining part T (T is Fe, or Fe and Co) and unavoidable impurities in addition to the above-listed components.

The RLL is a light rare-earth element, and contains Nd with no exception. It is preferred that the content of Nd in RLL is 80 mass % or higher of the overall content of RLL. Examples of the light rare-earth element include La, Ce, Nd, Pr, Pm, Sm, Eu and the like. Examples of the unavoidable impurities include O (oxygen), N (nitrogen), C (carbon) and the like. In order to provide higher $B_r$ and higher $H_{cJ}$, it is preferred that 0.01 mass %≤[oxygen]≤0.15 mass % is satisfied, where [oxygen] is the content (mass %) of oxygen.

Preferably, the sintered R1-T-B based magnet work satisfies the following expression (1), where [T] is the content (mass %) of T, and [B] is the content (mass %) of B.

$$[T]/55.85>14\times[B]/10.8 \quad (1)$$

The sintered R1-T-B based magnet work satisfying expression (1) indicates that the content of B is lower than the content defined by the stoichiometric ratio of the $R_2T_{14}B$ compound, namely, indicates that the amount of B is smaller than the amount of T used to form the main phase ($R_2T_{14}B$ compound). In the case of satisfying expression (1), the sintered R1-T-B based magnet work has higher $H_{cJ}$.

Now, a method for preparing a sintered R1-T-B based magnet work will be described. The sintered R1-T-B based magnet work may be prepared by using a generic method for producing a sintered R-T-B based magnet, e.g., a sintered Nd—Fe—B based magnet. In one example, a raw material alloy which is produced by a strip casting method or the like may be pulverized to not less than 3 μm and not more than 10 μm by using a jet mill or the like, pressed in a magnetic field, and then sintered at a temperature that is not lower than 900° C. and not higher than 1100° C.

In the case where the particle size of the pulverized particles (central value of volume obtained through measurement by an airflow-dispersion laser diffraction method=$D_{50}$) of the raw material alloy is less than 3 μm, it is very difficult to produce pulverized powder, thus resulting in a greatly reduced production efficiency, which is not preferable. By contrast, in the case where the particle size of the pulverized particles exceeds 10 μm, the sintered R-T-B based magnet finally obtained has too large a crystal grain size to achieve high $H_{cJ}$, which is not preferable. So long as the aforementioned conditions are satisfied, the sintered R1-T-B based magnet work may be produced from one type of raw material alloy (a single raw-material alloy), or through a method of using and blending two or more types of raw material alloys (blend method).

(Step of Preparing an R2-Ga Alloy)

First, a composition of the R2-Ga alloy will be described.

The R2 in the R2-Ga alloy refers to at least two types of rare-earth elements, and contains Tb and Pr with no exception. Preferably, the content of R2 is not lower than 65 mass % and not higher than 97 mass % of the entirety of the R2-Ga alloy, and the content of Ga is not lower than 3 mass % and not higher than 35 mass % of the entirety of the R2-Ga alloy. It is preferred that the content of Tb in R2 is not lower than 3 mass % and not higher than 24 mass % of the entirety of the R2-Ga alloy. It is preferred that the content of Pr in R2 is not lower than 65 mass % and not higher than 86 mass % of the entirety of the R2-Ga alloy. At most 50 mass % of Ga may be replaced with at least one of Cu and Sn. The R2-Ga alloy may contain unavoidable impurities. The expression that "at most 50 mass % of Ga may be replaced with Cu" in the present disclosure indicates that where the content (mass %) of Ga in the R2-Ga alloy is 100%, at most 50% thereof may be replaced with Cu. Preferably, the content of Pr in the R2-Ga alloy is 50 mass % or higher of the entirety of R2. More preferably, R2 is formed of only Pr and Tb. In the case where R2 contains Pr, the diffusion in the grain boundary phase progresses more easily, which diffuses Tb more efficiently and thus provides higher $H_{cJ}$.

The R2-Ga alloy may have any shape or size with no specific limitation. The R2-Ga alloy may be in the form of film, foil, powder, blocks, particles or the like.

Now, a method for preparing the R2-Ga alloy will be described.

The R2-Ga alloy may be prepared by a method for producing a raw material alloy that is adopted in generic methods for producing a sintered R-T-B based magnet, e.g., a mold casting method, a strip casting method, a single roll rapid quenching method (melt spinning method), an atomizing method, or the like. The R2-Ga alloy may be obtained by pulverizing an alloy obtained as above with a known pulverization device such as a pin mill or the like.

(Diffusion Step)

In the diffusion step, while at least a portion of the R2-Ga alloy is kept in contact with at least a portion of the surface of the sintered R1-T-B based magnet work prepared as described above, the first heat treatment is performed at a temperature not lower than 700° C. and not higher than 950° C. in a vacuum or an inert gas atmosphere. In this manner, R2 and Ga are diffused into the interior of the magnet work. As a result, a liquid phase containing Tb, Pr and Ga are generated from the R2-Ga alloy, and the liquid phase is introduced from the surface into the interior of the sintered R1-T-B based magnet work through diffusion, via grain boundaries in the sintered R1-T-B based magnet work. At this point, it is preferred that the content of RH in the sintered R1-T-B based magnet work is increased at a level in an infinitesimal range that is not lower than 0.05 mass % and not higher than 0.35 mass %. This provides a very high effect of improving the $H_{cJ}$. In order to increase the content of Tb in the sintered R1-T-B based magnet work by a level not lower than 0.05 mass % and not higher than 0.35 mass %, various conditions may be adjusted such as the amount of the R2-Ga alloy, the heating temperature during the heat treatment, the particle size (in the case where the R2-Ga alloy is in a particle form), the heat treatment time, and the like. Among these conditions, adjustment on the amount of the R2-Ga alloy and the heating temperature during the heat treatment controls the amount of introduction (amount of increase) of RH relatively easily. It should be noted for the sake of clarity that in the present specification, the expression "increasing the content of Tb by a level not lower than 0.05 mass % and not higher than 0.35 mass %" indicates that the value of the content as expressed in mass % is increased by a level not lower than 0.05 and not higher than 0.35. For example, in the case where the content of Tb in the sintered R1-T-B based magnet work before the diffusion step is 0.50 mass % and the content of Tb in the sintered R-T-B based magnet after the diffusion step is 0.60 mass %, the content of Tb is increased by 0.10 mass % by the diffusion step. Whether or not the content of at least one of Tb and Dy (RH amount) is increased by a level not lower than 0.05 mass % and not higher than 0.35 mass % may be checked by measuring the content of Tb in each of the entirety of the sintered R1-T-B based magnet work before the diffusion step and the entirety of the sintered R-T-B based magnet after the diffusion step (or the sintered R-T-B based magnet after the second heat treatment) and thus finding how much the content of Tb is increased after the diffusion as compared with the content of Tb before the diffusion. In the case where any thickened portion of the R2-Ga alloy exists on the surface of the sintered R-T-B based magnet after the diffusion (or on the surface of the sintered R-T-B based magnet after the second heat treatment), the amount of RH is measured after the thickened portion is removed by cutting or the like.

In the case where the temperature of the first heat treatment is lower than 700° C., the amount of the liquid phase containing Tb, Pr and Ga is too small to provide high $H_{cJ}$. By contrast, in the case where the temperature of the first heat treatment exceeds 950° C., the $H_{cJ}$ may possibly be decreased. Preferably, the temperature of the first heat treatment is not lower than 850° C. and not higher than 950° C. With such a temperature range, higher $H_{cJ}$ is provided. It is preferred that the sintered R-T-B based magnet, obtained as a result of the first heat treatment (not lower than 700° C. and not higher than 950° C.), is cooled to 300° C. at a cooling rate of at least 5° C./minute from the temperature of the first heat treatment. With such a cooling rate, higher $H_{cJ}$ is provided. More preferably, the cooling rate down to 300° C. is at least 15° C./minute.

The first heat treatment may be performed by use of a known heat treatment apparatus on an R2-Ga alloy of an arbitrary shape located on the surface of the sintered R1-T-B based magnet work. For example, the first heat treatment may be performed while the surface of the sintered R1-T-B based magnet work is covered with a powder layer of the R2-Ga alloy. For example, a slurry having the R2-Ga alloy dispersed in a dispersion medium may be applied on the surface of the sintered R1-T-B based magnet work, and then the dispersion medium may be evaporated to allow the R2-Ga alloy to come into contact with the sintered R1-T-B based magnet work. Examples of the dispersion medium include alcohols (ethanol, etc.), aldehydes, and ketones. The RH is not limited to being introduced from the R2-Ga alloy, but may also be introduced by locating a fluoride, an oxide, an oxyfluoride, etc., of RH, together with the R2-Ga alloy, on the surface of the sintered R1-T-B based magnet. In other words, so long as RL and Ga are diffused simultaneously with RH, there is no specific limitation on the method of diffusion. Examples of the fluoride, oxide, and oxyfluoride of RH include $TbF_3$, $DyF_3$, $Tb_2O_3$, $Dy_2O_3$, $Tb_4OF$, and $Dy_4OF$.

The R2-Ga alloy may be placed at any position so long as at least a portion thereof is in contact with at least a portion of the sintered R1-T-B based magnet work. Preferably, the R2-Ga alloy is placed so as to be in contact with at least a surface of the sintered R1-T-B based magnet work that is perpendicular to the direction in which the sintered R1-T-B based magnet work is magnetically aligned. This allows a liquid phase containing R2 and Ga to be introduced from the surface into the interior of the magnet more efficiently through diffusion. In this case, the R2-Ga alloy may be in contact with the sintered R1-T-B based magnet work only at the surface perpendicular to the direction in which the sintered R1-T-B based magnet work is magnetically aligned, or may be in contact with the entire surface of the sintered R1-T-B based magnet work.

(Step of Performing a Second Heat Treatment)

The sintered R1-T-B based magnet work obtained as a result of the first heat treatment is subjected to a heat treatment at a temperature that is not lower than 450° C. and not higher than 750° C. but is lower than the temperature used in the step of performing the first heat treatment, in a vacuum or an inert gas atmosphere. In the present disclosure, this heat treatment is referred to as the "second heat treatment". The second heat treatment allows high $H_{cJ}$ to be provided. In the case where the second heat treatment is performed at higher temperature than that in the first heat treatment, or in the case where the temperature of the second heat treatment is lower than 450° C. or higher than 750° C., the sintered R-T-B based magnet may possibly not have high $H_{cJ}$.

EXAMPLES

Example 1

Raw materials of each of the elements were weighed such that the sintered R1-T-B based magnet works would have approximately the compositions shown in Nos. A through G in Table 1, and alloys were produced by a strip casting method. The resultant alloys were each coarse-pulverized by a hydrogen pulverizing method to obtain a coarse-pulverized powder. Next, zinc stearate as a lubricant was incorporated into, and mixed with, the resultant coarse-pulverized powder at a ratio of 0.04 mass % with respect to 100 mass % of the coarse-pulverized powder. Then, the resultant substance was dry-milled in a nitrogen jet by an airflow crusher (jet mill machine) to obtain a fine-pulverized powder (alloy powder) having a particle size $D_{50}$ of 4 μm. Zinc stearate as a lubricant was incorporated into, and mixed with, the resultant fine-pulverized powder at a ratio of 0.05 mass % with respect to 100 mass % of the fine-pulverized powder. Then, the resultant fine-pulverized powder was pressed in a magnetic field to obtain a compact. As a pressing apparatus, a so-called orthogonal magnetic field pressing apparatus (transverse magnetic field pressing apparatus) was used, in which the direction of magnetic field application was orthogonal to the pressurizing direction. The resultant compact was sintered at a temperature not lower than 1060° C. and not higher than 1090° C. (a temperature at which a sufficiently dense texture would result through sintering was selected for each sample) for 4 hours to obtain a sintered R1-T-B based magnet work. Such resultant sintered R1-T-B based magnet works each had a density of 7.5 $Mg/m^3$ or higher. Measurement results on the components of the resultant sintered R1-T-B based magnet works are shown in Table 1. The content of each of the components in Table 1 was measured by using Inductively Coupled Plasma Optical Emission Spectroscopy (ICP-OES). The content of O (oxygen) was measured by a gas fusion infrared absorption method by use of a gas analyzer. The content of each of the components is with respect to the entirety of the sintered R1-T-B based magnet work (average composition of the entirety of the magnet). The same is applicable to the components of the R2-Ga alloy and the components of the sintered R-T-B based magnet. Table 1 also shows the values of [RLL]−6×[oxygen] of the sintered R1-T-B based magnet works. The experimental examples other than No. F and No. G (i.e., Nos. A through E) exhibited values in the preferred range of [RLL]−6×[oxygen] according to the present disclosure (26.3 mass %≤[RLL]−6×[oxygen]≤28.6 mass %).

TABLE 1

| No. | COMPOSITION OF SINTERED Rl-T-B BASED MAGNET WORK (mass %) Nd | Pr | Tb | B | Co | Cu | Al | Ga | Fe | OXYGEN | [RLL] − 6 × [oxygen] |
|---|---|---|---|---|---|---|---|---|---|---|---|
| A | 28.0 | 0.0 | 0.0 | 0.96 | 0.50 | 0.10 | 0.10 | 0.10 | 70.2 | 0.07 | 27.6 |
| B | 28.0 | 0.0 | 0.0 | 0.94 | 0.50 | 0.10 | 0.05 | 0.20 | 70.2 | 0.10 | 27.4 |
| C | 28.0 | 0.0 | 0.0 | 0.92 | 0.50 | 0.10 | 0.05 | 0.20 | 70.2 | 0.10 | 27.4 |
| D | 28.5 | 0.0 | 0.0 | 0.96 | 0.50 | 0.10 | 0.10 | 0.10 | 69.7 | 0.12 | 27.8 |
| E | 27.5 | 0.0 | 0.0 | 0.98 | 0.50 | 0.10 | 0.05 | 0.30 | 70.6 | 0.10 | 26.9 |
| F | 29.6 | 0.0 | 0.0 | 0.98 | 0.50 | 0.10 | 0.10 | 0.10 | 68.6 | 0.12 | 28.9 |
| G | 26.9 | 0.0 | 0.0 | 0.98 | 0.50 | 0.10 | 0.05 | 0.10 | 71.4 | 0.12 | 26.2 |

Raw materials of each of the elements were weighed such that the R2-Ga alloy would have approximately the composition shown in No. a in Table 2, and the raw materials were melted to obtain an alloy in a ribbon or flake form by a single roll rapid quenching method (melt spinning method). The resultant alloy was pulverized in an argon atmosphere in a mortar, and then was passed through a sieve with an opening of 425 μm to prepare an R2-Ga alloy. Table 2 shows the composition of the resultant R2-Ga alloy. The content of each of the components shown in Table 2 was measured by using Inductively Coupled Plasma Optical Emission Spectroscopy (ICP-OES).

TABLE 2

| No. | COMPOSITION OF R2-Ga ALLOY (mass %) Pr | Tb | Ga | Cu |
|---|---|---|---|---|
| a | 75.0 | 9.0 | 8.0 | 8.0 |

The sintered R1-T-B based magnet works of Nos. A through G in Table 1 were each cut and ground into a 7.4 mm×7.4 mm×7.4 mm cube. Next, the R2-Ga alloy was spread onto the entire surface of each of the sintered R1-T-B based magnet works of Nos. A through G under the diffusion conditions shown in Table 3. No. 3 of Table 3 shows that 2 mass % of the R2-Ga alloy (No. a) was spread onto 100 mass % of the sintered R1-T-B based magnet work of No. B. No. 3 in Table 2 also shows that the same diffusion step was performed twice. Therefore, in No. 3, 4 mass % of the R2-Ga alloy was spread in total. Nos. 1 and 2 and Nos. 4 through 10 show the method of spreading in substantially the same manner. In the diffusion step, the sintered R1-T-B based magnet work was subjected to the first heat treatment at 900° C. in argon at a reduced pressure controlled to be 50 Pa for 4 hours, and then was cooled down to room temperature. As a result, the sintered R-T-B based magnet processed by the first heat treatment was obtained. Then, the sintered R-T-B based magnet obtained as a result of the first heat treatment was subjected to the second heat treatment at 480° C. in argon at a reduced pressure controlled to be 50 Pa for 3 hours, and then was cooled down to room temperature. In this manner, the sintered R-T-B based magnets (Nos. 1 through 10) were produced. Table 3 shows the amount of Tb, the amount of RL (in this example, Nd+Pr), the amount of oxygen and R' ([RL]−6×[oxygen]) of each of the resultant sintered R-T-B based magnets. The resultant sintered R-T-B based magnet samples were each mechanically processed into a 7 mm×7 mm×7 mm cube. The $B_r$ and the $H_{cJ}$ of each of the cubes were measured by a B-H tracer. The results of the measurement are shown in Table 3. A line analysis was performed by EDX on a cross-section of each of the magnets of Nos. 1 through 10, specifically, on a region from the surface to the vicinity of the center of the cross-section of each of the magnets. As a result, it was confirmed that the Tb, Pr and Ga concentrations were gradually decreased from the surface to the central region of the magnet (the concentrations were gradually lowered) in all the samples.

TABLE 3

| No. | SINTERED R1-T-B BASED MAGNET WORK | DIFFUSION CONDITIONS AMOUNT OF DIFFUSION SOURCE mass % | NUMBER OF TIMES OF DIFFUSION TIMES | MAGNETIC CHARACTERISTICS $B_r$ T | $H_{cJ}$ kA/m | COMPOSITION OF SINTERED R-T-B BASED MAGNET Tb mass % | RL mass % | OXYGEN mass % | R' mass % | REMARKS |
|---|---|---|---|---|---|---|---|---|---|---|
| 1 | B | 4 | 1 | 1.49 | 1910 | 0.18 | 28.5 | 0.11 | 27.8 | PRESENT INVENTION |
| 2 | B | 8 | 1 | 1.48 | 2050 | 0.30 | 28.7 | 0.11 | 28.0 | PRESENT INVENTION |
| 3 | B | 2 | 2 | 1.50 | 1930 | 0.20 | 28.5 | 0.11 | 27.8 | PRESENT INVENTION |
| 4 | B | 2 | 5 | 1.47 | 2100 | 0.34 | 28.9 | 0.11 | 28.2 | PRESENT INVENTION |
| 5 | A | 2 | 2 | 1.50 | 1910 | 0.18 | 28.5 | 0.07 | 28.1 | PRESENT INVENTION |
| 6 | C | 2 | 2 | 1.47 | 1980 | 0.20 | 28.9 | 0.13 | 28.1 | PRESENT INVENTION |
| 7 | D | 6 | 1 | 1.48 | 1940 | 0.28 | 29.2 | 0.12 | 28.5 | PRESENT INVENTION |
| 8 | E | 6 | 1 | 1.47 | 2000 | 0.28 | 28.0 | 0.12 | 27.3 | PRESENT INVENTION |

TABLE 3-continued

| | SINTERED | DIFFUSION CONDITIONS | | | | | | | | |
|---|---|---|---|---|---|---|---|---|---|---|
| | R1-T-B BASED | AMOUNT OF DIFFUSION | NUMBER OF TIMES OF | MAGNETIC CHARACTERISTICS | | COMPOSITION OF SINTERED R-T-B BASED MAGNET | | | | |
| No. | MAGNET WORK | SOURCE mass % | DIFFUSION TIMES | $B_r$ T | $H_{cJ}$ kA/m | Tb mass % | RL mass % | OXYGEN mass % | R' mass % | REMARKS |
| 9 | F | 2 | 3 | 1.44 | 1990 | 0.28 | 30.2 | 0.12 | 29.5 | COMPARATIVE EXAMPLE |
| 10 | G | 2 | 3 | 1.47 | 600 | 0.28 | 27.2 | 0.14 | 26.4 | COMPARATIVE EXAMPLE |

As shown in Table 3, all the sintered R-T-B based magnets according to the present disclosure have high $B_r$ and high $H_{cJ}$, more specifically, $B_r$ of 1.47 T or greater and $H_{cJ}$ of 1900 kA/m or greater. By contrast, the sintered R-T-B based magnets of Nos. 9 and 10 in comparative examples, in which R' is out of the range of the present disclosure, do not have high $B_r$ of 1.47 T or greater, or high $H_{cJ}$ of 1900 kA/m or greater.

Example 2

Sintered R1-T-B based magnet works were produced in substantially the same manner as in example 1 except that raw materials of each of the elements were weighed such that the sintered R1-T-B based magnet works would have approximately the compositions shown in Nos. H through P in Table 4. Measurement results on the components of the resultant sintered R1-T-B based magnet works are shown in Table 4.

TABLE 4

| | COMPOSITION OF SINTERED R1-T-B BASED MAGNET WORK (mass %) | | | | | | | | | | [RLL] − |
|---|---|---|---|---|---|---|---|---|---|---|---|
| No. | Nd | Pr | Tb | B | Co | Cu | Al | Ga | Fe | OXYGEN | 6 × [oxygen] |
| H | 25.2 | 3.5 | 0.0 | 0.95 | 0.20 | 0.10 | 0.10 | 0.10 | 69.9 | 0.13 | 27.9 |
| I | 25.0 | 3.5 | 0.0 | 0.95 | 1.00 | 0.10 | 0.10 | 0.10 | 69.3 | 0.09 | 28.0 |
| J | 28.7 | 0.0 | 0.0 | 0.95 | 0.50 | 0.05 | 0.10 | 0.10 | 69.6 | 0.15 | 27.8 |
| K | 28.7 | 0.0 | 0.0 | 0.95 | 0.50 | 0.30 | 0.10 | 0.10 | 69.4 | 0.10 | 28.1 |
| L | 29.0 | 0.0 | 0.0 | 0.95 | 0.50 | 0.50 | 0.10 | 0.10 | 68.9 | 0.13 | 28.2 |
| M | 28.7 | 0.0 | 0.0 | 0.95 | 0.50 | 0.1 | 0.2 | 0.10 | 69.5 | 0.10 | 28.1 |
| N | 28.7 | 0.0 | 0.0 | 0.95 | 0.50 | 0.1 | 0.3 | 0.10 | 69.4 | 0.09 | 28.2 |
| O | 29.1 | 0.0 | 0.0 | 0.95 | 0.50 | 0.1 | 0.10 | 0.5 | 68.8 | 0.11 | 28.4 |
| P | 28.7 | 0.0 | 0.0 | 0.95 | 0.50 | 0.1 | 0.10 | 0.7 | 69.0 | 0.17 | 27.7 |

R2-Ga alloys were prepared in substantially the same manner as in example 1 except that raw materials of each of the elements were weighed such that the R2-Ga alloys would have approximately the compositions shown in Nos. b and c in Table 5. Compositions of the resultant R2-Ga alloys are shown in Table 5.

TABLE 5

| | COMPOSITION OF R2-Ga ALLOY (mass %) | | | | |
|---|---|---|---|---|---|
| No. | Pr | Nd | Tb | Ga | Cu |
| b | 74.0 | — | 14.0 | 9.0 | 3.0 |
| c | 49.0 | 20.0 | 15.0 | 8.0 | 8.0 |

The sintered R1-T-B based magnet works of Nos. H through P in Table 4 were each cut and ground into a 7.4 mm×7.4 mm×7.4 mm cube, and the R2-Ga alloy was spread under the conditions shown in Table 6 in substantially the same manner as in example 1. The R2-Ga alloy of No. b was spread onto the sintered R1-T-B based magnet works of Nos. H through P. Separately, the R2-Ga alloy of No. c was spread onto the sintered R1-T-B based magnet work of No. H. The diffusion step (first heat treatment) and the second heat treatment were performed in substantially the same manner as in example 1, and as a result, sintered R-T-B based magnets (Nos. 11 through 20) were obtained. Table 6 shows the amount of Tb, the amount of RL, the amount of oxygen and R' ([RL]−6×[oxygen]) of each of the resultant sintered R-T-B based magnets. The resultant sintered R-T-B based magnet samples were each mechanically processed into a 7 mm×7 mm×7 mm cube. The $B_r$ and the $H_{cJ}$ of each of the cubes were measured by a B-H tracer. The results of the measurement are shown in Table 6. A line analysis was performed by EDX on a cross-section of each of the magnets of Nos. 11 through 20, specifically, on a region from the surface to the vicinity of the center of the cross-section of each of the magnets. As a result, it was confirmed that the Tb, Pr and Ga concentrations were gradually decreased from the surface to the central region of the magnet (the concentrations were gradually lowered) in all the samples.

TABLE 6

| | SINTERED | DIFFUSION CONDITIONS | | | | | | | | |
|---|---|---|---|---|---|---|---|---|---|---|
| | R1-T-B BASED | AMOUNT OF DIFFUSION | NUMBER OF TIMES OF | MAGNETIC CHARACTERISTICS | | COMPOSITION OF SINTERED R-T-B BASED MAGNET | | | | |
| No. | MAGNET WORK | SOURCE mass % | DIFFUSION TIMES | $B_r$ T | $H_{cJ}$ kA/m | Tb mass % | RL mass % | OXYGEN mass % | R' mass % | REMARKS |
| 11 | H | 3.5 | 1 | 1.48 | 1960 | 0.25 | 29.2 | 0.14 | 28.4 | PRESENT INVENTION |
| 12 | I | 3.5 | 1 | 1.48 | 1930 | 0.25 | 29.0 | 0.11 | 28.3 | PRESENT INVENTION |
| 13 | J | 3.5 | 1 | 1.48 | 1920 | 0.26 | 29.2 | 0.16 | 28.2 | PRESENT INVENTION |
| 14 | K | 3.5 | 1 | 1.48 | 1960 | 0.27 | 29.2 | 0.11 | 28.5 | PRESENT INVENTION |
| 15 | L | 3.5 | 1 | 1.47 | 1990 | 0.25 | 29.5 | 0.14 | 28.7 | PRESENT INVENTION |
| 16 | M | 3.5 | 1 | 1.48 | 1940 | 0.23 | 29.2 | 0.11 | 28.5 | PRESENT INVENTION |
| 17 | N | 3.5 | 1 | 1.47 | 1950 | 0.20 | 29.2 | 0.11 | 28.5 | PRESENT INVENTION |
| 18 | O | 3.5 | 1 | 1.48 | 2040 | 0.30 | 29.6 | 0.15 | 28.7 | PRESENT INVENTION |
| 19 | P | 3.5 | 1 | 1.47 | 1980 | 0.25 | 29.2 | 0.17 | 28.2 | PRESENT INVENTION |
| 20 | H | 3.5 | 1 | 1.47 | 2010 | 0.28 | 29.2 | 0.14 | 28.4 | PRESENT INVENTION |

As shown in Table 6, all the sintered R-T-B based magnets according to the present disclosure have high $B_r$ and high $H_{cJ}$, more specifically, $B_r$ of 1.47 T or greater and $H_{cJ}$ of 1900 kA/m or greater.

According to the present disclosure, a sintered R-T-B based magnet having high remanence and high coercivity is produced. The sintered magnet according to the present disclosure is preferable to, for example, various motors such as motors mounted on hybrid vehicles and home appliance products that are subjected to high temperature.

What is claimed is:

1. A sintered R-T-B based magnet comprising:

a main phase which includes $R_2T_{14}B$ compound particles;

a grain boundary phase which is at grain boundaries of the main phase;

a portion in which a concentration of Tb gradually decreases from a surface toward an interior of the magnet;

a portion in which a concentration of Pr gradually decreases from the surface toward the interior of the magnet;

a portion in which a concentration of Ga gradually decreases from the surface toward the interior of the magnet;

Tb at a content of 0.30 mass % or lower, wherein the sintered R-T-B magnet:

has a remanence ($B_r$) of 1.47 T or greater and coercivity ($H_{cJ}$) of 1900 kA/m or greater, includes RL (RL is at least one type of light rare-earth element and includes Nd and Pr), and satisfies 26.5 mass %≤[RL]−6[oxygen]≤28.8 mass %, where [RL] is the content (mass %) of RL and [oxygen] is the content (mass %) of oxygen, and satisfies 0.07 mass %≤[oxygen]≤0.15 mass %.

* * * * *